US007133018B2

(12) United States Patent
Kim et al.

(10) Patent No.: US 7,133,018 B2
(45) Date of Patent: Nov. 7, 2006

(54) SUPER TWIST NEMATIC LIQUID CRYSTAL DISPLAY DRIVER FOR REDUCING POWER CONSUMPTION

(75) Inventors: Hyong-rae Kim, Suwon (KR); Jae-ho Park, Yongin (KR)

(73) Assignee: Samsung Electronics, Co.,Ltd. (KR)

( * ) Notice: Subject to any disclaimer, the term of this patent is extended or adjusted under 35 U.S.C. 154(b) by 544 days.

(21) Appl. No.: 10/712,567

(22) Filed: Nov. 13, 2003

(65) Prior Publication Data

US 2004/0104875 A1 Jun. 3, 2004

(30) Foreign Application Priority Data

Nov. 16, 2002 (KR) ..... 10-2002-0071390

(51) Int. Cl.
*G09G 3/36* (2006.01)

(52) U.S. Cl. ..... 345/100; 345/211; 345/204

(58) Field of Classification Search ..... 345/87–103, 345/204, 211

See application file for complete search history.

(56) References Cited

U.S. PATENT DOCUMENTS

| | | | | |
|---|---|---|---|---|
| 5,323,171 | A * | 6/1994 | Yokouchi et al. | 345/94 |
| 6,898,096 | B1 * | 5/2005 | Endo et al. | 363/147 |
| 2004/0095342 | A1 * | 5/2004 | Lee et al. | 345/211 |

FOREIGN PATENT DOCUMENTS

| | | |
|---|---|---|
| JP | 11-272238 | 10/1999 |
| KR | 2002-0037282 | 5/2002 |

* cited by examiner

*Primary Examiner*—Lun-Yi Lao
(74) *Attorney, Agent, or Firm*—Mills & Onello LLP

(57) ABSTRACT

Provided is a super twist nematic (STN) liquid crystal display (LCD) driver which reduces power consumption. The STN LCD driver includes a reference voltage generating unit, a voltage boosting unit, a voltage control unit, a first common voltage generating unit, and a second common voltage generating unit. The reference voltage generating unit generates a reference voltage in response to an external voltage. The voltage boosting unit generates a boosting voltage by boosting the external voltage. The voltage control unit generates a first segment voltage and a second segment voltage which drive a segment electrode of the STN LCD panel in response to the reference voltage and the boosting voltage. The first common voltage generating unit drives a common voltage of the STN LCD panel in response to the external voltage, a ground voltage, and the first segment voltage and generates a first common voltage, the voltage level of which is higher than the voltage level of the first segment voltage, using a predetermined resistance ratio. The second common voltage generating unit drives a common voltage STN LCD panel in response to the external voltage, the ground voltage, and the first segment voltage and generates a second common voltage, the voltage level of which is lower than the voltage level of the first segment voltage, using a predetermined resistance ratio.

29 Claims, 8 Drawing Sheets

SUPER TWIST NEMATIC LIQUID CRYSTAL DISPLAY DRIVER FOR REDUCING POWER CONSUMPTION

BACKGROUND OF THE INVENTION

This application claims priority from Korean Patent Application No. 2002-71390, filed on 16 Nov. 2002, in the Korean Intellectual Property Office, the contents of which are incorporated herein in their entirety by reference.

1. Field of the Invention

The present invention relates to a super twist nematic (STN) liquid crystal display (LCD) driver, and more particularly, to a driver for driving a STN LCD panel by using a multi-line selection method and an Alt-Pleshko technique (APT).

2. Description of the Related Art

In a super twist nematic (STN) liquid crystal display (LCD), a character or a picture is displayed on a screen by a liquid crystalline polymer twisted to reflect light. The liquid crystalline polymer is called nematic. The STN LCD is used to display simple numbers or characters in a calculator, a display unit of a mobile phone, and so on.

The STN LCD presents colors through contrast in gray scale. A screen using 16 shades of gray can present colors through 16 different contrasts, thus there is no problem in presenting text files inputted, outputted, or edited in the screen. The STN LCD basically uses white and black inversion and can improve visibility by presenting black characteristics on a white background or white characteristics on a black background in a text mode.

The method of driving the STN LCD includes a multi line selection method and a single line selection method. If the response time of the STN LCD is increased, a so-called frame response occurs causing flickering or a deterioration of contrast.

The multi-line selection method is used to solve such problems. The multi-line selection method selects a plurality of scan electrode lines at one time.

The multi-line selection method includes a three-line selection method and a four-line selection method.

FIG. 1 is a circuit diagram of an STN LCD driver 100 using the four-line selection method.

The STN LCD driver 100 requires at least seven voltage levels to drive a STN LCD panel (not shown).

A first common voltage V3 and a second common voltage −MV3 are applied to a row line of the STN LCD panel (not shown). The number of transitions of the first common voltage V3 and the second common voltage −MV3, i.e., voltages applied to the row line, is smaller than that of first through fifth segment voltages VC, V1, V2, MV1, and MV2 which are applied to a column line. Thus, the width of the voltage swing of the voltages applied to the row line becomes great, which means that the voltage level applied to the row line is high.

The first through fifth segment voltages VC, V1, V2, MV1, and MV2 are applied to the column line of the STN LCD panel (not shown) as described above. The first segment voltage VC, the second segment voltage V1, the third segment voltage V2, the fourth segment voltage MV1, and the fifth segment voltage MV2 are generated from a reference voltage generating unit 130 and a voltage control circuit 140. The relationship between the voltage levels of the first through fifth segment voltages VC, V1, V2, MV1, and MV2 is V2>V1>VC>MV1>MV2. The differences between two voltage levels, for example, V2 and V1, or V1 and VC, are equal to one another.

A supply voltage VDD is applied to the reference voltage generating unit 130 and a first boosting circuit 150. The reference voltage generating unit 130, which receives the supply voltage VDD, generates the third segment voltage V2 by using the voltage control circuit 140. Voltage levels between the third segment voltage V2 and a ground voltage GND are divided by resistances R into the first segment voltage VC, the second segment voltage V1, and the fourth segment voltage MV1. A boosting voltage VCSL outputted from the first boosting circuit 150 is applied to voltage followers 160, 170, and 180. The voltage followers 170, 160, and 180 stabilize the first segment voltage VC, the second segment voltage V1, and the fourth segment voltage MV1, respectively.

The first common voltage V3 is generated from a second boosting circuit 110. The second boosting circuit 110 receives the third segment voltage V2, boosts the level of the third segment voltage V2 to twice the level of the third segment voltage V2, and outputs the first common voltage V3.

A second common voltage −MV3 is generated from the second dropping circuit 120. The second dropping circuit 120 receives the third segment voltage V2, boosts the level of the third segment voltage V2 to twice the level of the ground voltage GND, and outputs the second common voltage −MV3.

FIG. 2 is a circuit diagram of an STN LCD driver 200 using a three-line selection method.

The STN LCD driver 200 using the three-line selection method requires at least five voltage levels to drive a STN LCD panel (not shown).

A first common voltage +VR and a second common voltage −VR are applied to a row line of the STN LCD panel (not shown). The number of transitions of the first common voltage +VR and the second common voltage −VR, i.e., the voltages applied to the row line, is smaller than voltages V1, VM, and GND applied to a column of the STN LCD panel. Thus, the width of the voltage swing of the voltages applied to the row line becomes great.

First through third segment voltages VM, V1, and VSS are applied to the column line of the STN LCD panel (not shown). The relationship between voltage levels of the first through third segment voltage VM, V1, and VSS is V1>VM>VSS. The differences between two voltage levels, e.g., V1 and VM, or VM and VSS, are equal to one another.

An external voltage VCI is applied to a reference voltage generating unit 230 and a first boosting circuit 260 differently from the STN CLD driver 100 using the four-line selection method of FIG. 1. The reference voltage generating unit 230 which receives the external voltage VCI generates the second segment voltage V1 by using a voltage control circuit 240 and an electric volume 250. The voltage levels between the second segment voltage V1 and the third segment voltage VSS are divided by resistances R and an adjustable resistance RV into the first segment voltage VM.

A random voltage VX is required to generate the second common voltage −VR. The level of the random voltage VX is determined by the adjustable resistance RV. The second common voltage −VR is generated by boosting the random voltage VX to three through five times its original value.

The first common voltage +VR is generated by boosting the second common voltage −VR to twice the second common voltage −VR.

Both the STN LCD drivers 100 and 200 of FIGS. 1 and 2 require a boosting circuit and a dropping circuit to generate a common voltage at a high level. The boosting circuit and the dropping circuit require an external capacitor to boost and drop voltages.

A bias capacitor is required to avoid the effect of loads of the STN LCD panel to the segment voltages and common voltages. An external capacitor is presented as C in FIG. 2, and a bias capacitor is presented as C1 in FIG. 2.

Referring to FIG. 1, the first boosting circuit 150 requires at least two external capacitors to boost the supply voltage VDD to twice the supply voltage VDD and at least three external capacitors to boost the supply voltage VDD to three times the supply voltage VDD. The second boosting circuit 110 requires at least two external capacitors to boost and drop voltages to twice the voltages. The second dropping circuit 120 requires at least two external capacitors to boost and drop voltages to twice the voltages. At least four bias capacitors are required to stabilize the first through fourth segment voltages VC, V1, V2, and MV1. Thus, the STN LCD driver 100 requires at least 11 total capacitors.

Referring to FIG. 2, the first boosting circuit 260 requires at least two external capacitors to boost the external voltage VCI to twice the external voltage VCI, and the second boosting circuit 210 requires at least two external capacitors to boost voltages to twice the voltages. The second dropping circuit 220 requires at least three through five external capacitors to boost the random voltage VX to three through five times the random voltage VX. At least three bias capacitors are required to stabilize the first segment voltage VM, the second segment voltage V1, and the random voltage VX. Thus, the STN LCD driver 200 requires 10–12 capacitors.

When a number of external capacitors are included in an STN LCD driver, module manufacturers have to bear increases in the production cost and the number of defective modules, and the volume of the module increases as well. In addition, since the boosting circuit and the dropping circuit have to operate continuously, power consumption increases accordingly.

SUMMARY OF THE INVENTION

The present invention provides a super twist nematic (STN) liquid crystal display (LCD) driver which requires a reduced number of external capacitors and minimizes power consumption.

According to a first embodiment of the present invention, there is provided a super twist nematic (STN) liquid crystal display (LCD) driver which drives a STN LCD panel. The STN LCD driver comprises a reference voltage generating unit which generates a reference voltage in response to an external voltage, a voltage boosting unit which generates a boosting voltage by boosting the external voltage, a voltage control unit which generates a first segment voltage and a second segment voltage which drive a segment electrode of the STN LCD panel in response to the reference voltage and the boosting voltage, a first common voltage generating unit which drives a common voltage of the STN LCD panel in response to the external voltage, a ground voltage, and the first segment voltage and generates a first common voltage, the voltage level of which is higher than the voltage level of the first segment voltage, using a predetermined resistance ratio, and a second common voltage generating unit which drives a common voltage of the STN LCD panel in response to the external voltage, the ground voltage, and the first segment voltage and generates a second common voltage, the voltage level of which is lower than the voltage level of the first segment voltage, using a predetermined resistance ratio.

The voltage boosting unit can include a boosting circuit, which has a charge capacitor, and receives and boosts the external voltage. The first common voltage generating unit can comprise a common boosting circuit which generates the first common voltage in response to the external voltage and the ground voltage, and a boosting comparing circuit which turns off the common boosting circuit if the voltage level of a first common division voltage is higher than the voltage level of the first segment voltage and turns on the common boosting circuit if the voltage level of the first common division voltage is lower than the voltage level of the first segment voltage. The voltage level of the first common division voltage is generated by dividing the voltage level of the first common voltage using a predetermined resistance ratio.

In one embodiment, the boosting comparing circuit comprises a boosting comparator which has a negative input end connected to the first segment voltage, a positive input end connected to the first common division voltage, and an output end that turns on or off the common boosting circuit, a boosting adjustable resistance which is connected between an output end of the common boosting circuit and the positive input end of the boosting comparator, and a boosting resistance which is connected between the positive input end of the boosting comparator and the ground voltage.

In one embodiment, the common boosting circuit includes a charge capacitor therein.

In one embodiment, the second common voltage generating unit comprises a common dropping circuit which generates the second common voltage in response to the external voltage and the ground voltage, and a dropping comparing circuit which turns on the common dropping circuit if the voltage level of a second common division voltage is higher than the voltage level of the first segment voltage and turns off the common dropping circuit if the voltage level of the second common division voltage is lower than the voltage level of the first segment voltage. The voltage level of the second common division voltage is generated by dividing the voltage level of the second common voltage using a predetermined resistance ratio.

In one embodiment, the dropping comparing circuit comprises a dropping comparator which has a negative input end connected to the first segment voltage, a positive input end connected to the second common division voltage, and an output end that turns on or off the common dropping circuit, a dropping adjustable resistance which is connected between an output end of the common dropping circuit and the positive input end of the dropping comparator, and a dropping resistance which is connected between the positive input end of the dropping comparator and the second segment voltage.

In one embodiment, the common dropping circuit includes a charge capacitor therein.

According to another aspect of the present invention, there is provided a super twist nematic (STN) liquid crystal display (LCD) driver which drives an STN LCD panel. The STN LCD driver comprises a reference voltage generating unit which generates a reference voltage in response to an external voltage, a first segment voltage generating unit which receives the reference voltage in response to the external voltage and generates a first segment voltage which drives a segment electrode of the STN LCD panel, a second segment voltage generating unit which generates a second segment voltage by boosting the first segment voltage, a first common voltage generating unit which drives a common electrode of the STN LCD panel in response to the external voltage, the ground voltage, and the first segment voltage and generates a first common voltage, the voltage level of which is higher than the voltage level of the first segment voltage, using a predetermined resistance ratio, and a second common voltage generating unit which drives a common electrode of the STN LCD panel in response to the external voltage, the ground voltage, and the first segment voltage and generates a second common voltage, the voltage level of which is higher than the voltage level of the first segment voltage, using a predetermined resistance ratio.

In one embodiment, the second segment voltage generating unit comprises a boosting circuit, which has a charge capacitor, and receives and boosts the first segment voltage.

The second segment voltage generating unit can also include a segment voltage comparing circuit which turns off the boosting circuit if the voltage level of a segment division voltage is higher than the voltage level of the first segment voltage and turns on the boosting circuit if the voltage level of the segment division voltage is lower than the voltage level of the first segment voltage. The voltage level of the segment division level is generated by dividing the voltage level of the second segment voltage using a predetermined resistance ratio.

In one embodiment, the segment voltage comparing circuit further comprises a segment voltage comparator which has a negative input end connected to the first segment voltage, a positive input end connected to the segment division voltage, and an output end that turns on or off the boosting circuit, a first segment resistance which is connected between an output end of the boosting circuit and the positive input end of the segment voltage comparator, and a second segment resistance which is connected between the positive input end of the segment voltage comparator and the ground voltage.

In one embodiment, the first common voltage generating unit further comprises a common boosting circuit which generates the first common voltage in response to the external voltage and the ground voltage, and a boosting comparing circuit which turns off the common boosting circuit if the voltage level of a first common division voltage is higher than the voltage level of the first segment voltage and turns on the common boosting circuit if the voltage level of the first common division voltage is lower than the voltage level of the first segment voltage. The voltage level of the first common division voltage is generated by dividing the voltage level of the first common voltage using a predetermined resistance ratio.

In one embodiment, the boosting comparing circuit comprises a boosting comparator which has a negative input end connected to the first segment voltage, a positive input end connected to the first common division voltage, and an output end that turns on or off the common boosting circuit, a boosting adjustable resistance which is connected between an output end of the common boosting circuit and the positive input end of the boosting comparator, and a boosting resistance which is connected between the positive input end of the boosting comparator and the ground voltage.

In one embodiment, the common boosting circuit includes a charge capacitor therein.

In one embodiment, the second common voltage generating unit comprises a common dropping circuit which generates the second common voltage in response to the external voltage and the ground voltage and a dropping comparing circuit which turns on the common dropping circuit if the voltage level of a second common division voltage is higher than the voltage level of the first segment voltage and turns off the common boosting circuit if the voltage level of the second common division voltage is lower than the voltage level of the first segment voltage. The voltage level of the second common division voltage is generated by dividing the voltage level of the second common voltage using a predetermined resistance ratio.

In one embodiment, the dropping comparing circuit comprises a dropping comparator which has a negative input end connected to the first segment voltage, a positive input end connected to the second common division voltage, and an output end that turns on or off the common dropping circuit, a dropping adjustable resistance which is connected between an output end of the common dropping circuit and the positive input end of the dropping comparator, and a dropping resistance which is connected between the positive input end of the dropping comparator and the second segment voltage. In one embodiment, the common dropping circuit includes a charge capacitor therein.

According to yet another aspect of the present invention, there is provided a super twist nematic (STN) liquid crystal display (LCD) driver which drives an STN LCD panel. The STN LCD driver comprises a reference voltage generating unit which generates a reference voltage in response to an external voltage, a first segment voltage generating unit which receives the reference voltage in response to the external voltage and generates a first segment voltage driving a segment electrode of the STN LCD panel, a second segment voltage generating unit which generates a second segment voltage by boosting the first segment voltage, a first common voltage generating unit which drives a common electrode of the STN LCD panel in response to a second common voltage and the first segment voltage and generates a first common voltage having a voltage level that is N ( where N is an integer) times the difference of the voltage level of the second common voltage from the voltage level of the first segment voltage, and a second common voltage generating unit which drives a common electrode of the STN LCD panel in response to the external voltage, the ground voltage, and the first segment voltage and generates the second common voltage having a voltage level that is lower than the voltage level of the first segment voltage using a predetermined resistance ratio.

In one embodiment, the second segment voltage generating unit comprises a boosting circuit, which has a charge capacitor therein, and receives and boosts the first segment voltage.

The second segment voltage generating unit can include a segment voltage comparing circuit which turns off the boosting circuit if the voltage level of a segment division voltage is higher than the voltage level of the first segment voltage and turns on the boosting circuit if the voltage level of the segment division voltage is lower than the voltage level of the first segment voltage. The voltage level of the segment division voltage is generated by dividing the voltage level of the segment voltage using a predetermined resistance ratio.

The segment voltage comparing circuit can include a segment voltage comparator which has a negative input end connected to the first segment voltage, a positive input end connected to the segment division voltage, and an output end that turns on or off the boosting circuit, a first segment resistance which is connected between an output end of the boosting circuit and the positive input end of the segment voltage comparator, and a second segment resistance which is connected between the positive input end of the segment voltage comparator and the ground voltage.

The second common voltage generating unit can include a common dropping circuit which generates the second common voltage in response to the external voltage and the ground voltage and a dropping comparing circuit which turns on the common dropping circuit if the voltage level of a common division voltage is higher than the voltage level of the first segment voltage and turns off the common dropping circuit if the voltage level of the common division voltage is lower than the voltage level of the first segment voltage. The voltage level of the common division voltage is generated by dividing the voltage level of the second common voltageusing a predetermined resistance ratio.

In one embodiment, the dropping comparing circuit comprises a dropping comparator which has a negative input end connected to the first segment voltage, a positive input end connected to the common division voltage, and an output end that turns on or off the common dropping circuit, a dropping adjustable resistance which is connected between an output end of the common dropping circuit and the positive input end of the dropping comparator, and a dropping resistance which is connected between the positive input end of the dropping comparator and the second segment voltage.

The common dropping circuit can include a charge capacitor therein.

The first common voltage generating unit can include a common boosting circuit which receives and boosts the second common voltage, and wherein the common boosting circuit includes a charge capacitor therein.

According to yet another aspect of the present invention, there is provided a super twist nematic (STN) liquid crystal display (LCD) driver which drives an STN LCD panel. The STN LCD driver comprises a reference voltage generating unit which generates a reference voltage in response to an external voltage, a voltage boosting unit which generates a boosting voltage by boosting the external voltage, a voltage control unit which generates a first segment voltage and a second segment voltage which drive a segment electrode of the STN LCD panel in response to the reference voltage and the boosting voltage, a first common voltage generating unit which drives a common electrode of the STN LCD panel in response to a ground voltage and the second segment voltage and generates a first common voltage having a voltage level that is M (where M is an integer) times the difference of, the voltage level of the ground voltage from the voltage level of the second segment voltage, and a second common voltage generating unit which drives a common electrode of the STN panel in response to the ground voltage and the second segment voltage and generates a second common voltage having a voltage level that is 1/M times the difference of the voltage level of the ground voltage from the voltage level of the second segment voltage.

In one embodiment, the voltage boosting unit, the first common voltage generating unit, and the second common voltage generating unit each include a boosting circuit, the boosting circuit including a charge capacitor therein.

In one embodiment, the voltage level of the second segment voltage is double the voltage level of the first segment voltage.

BRIEF DESCRIPTION OF THE DRAWINGS

The foregoing and other objects, features and advantages of the invention will be apparent from the more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS OF THE INVENTION

Figure 1:
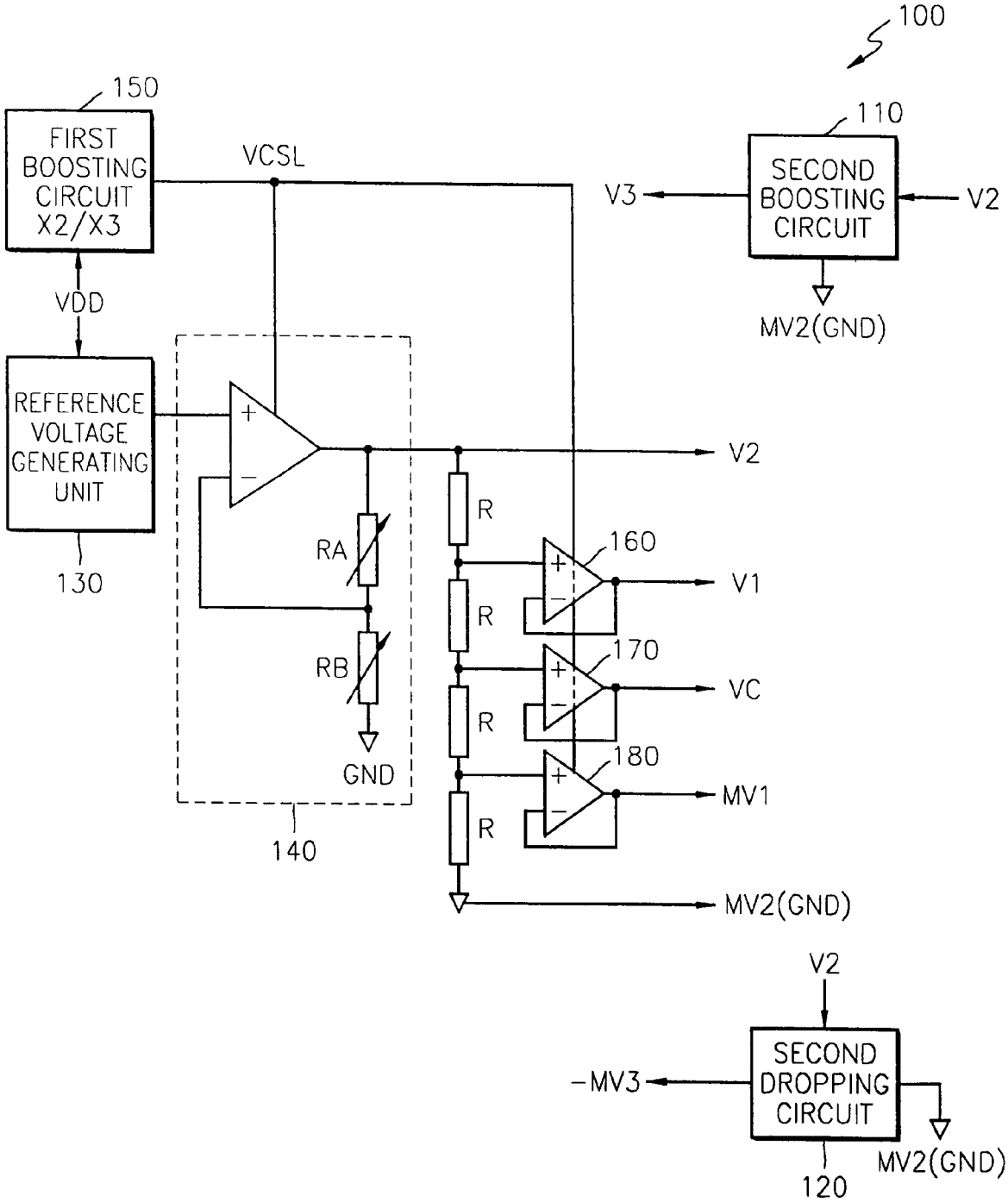
FIG. 1 is a circuit diagram of a super twist nematic (STN) liquid crystal display (LCD) driver using a four-line selection method.
Figure 2:
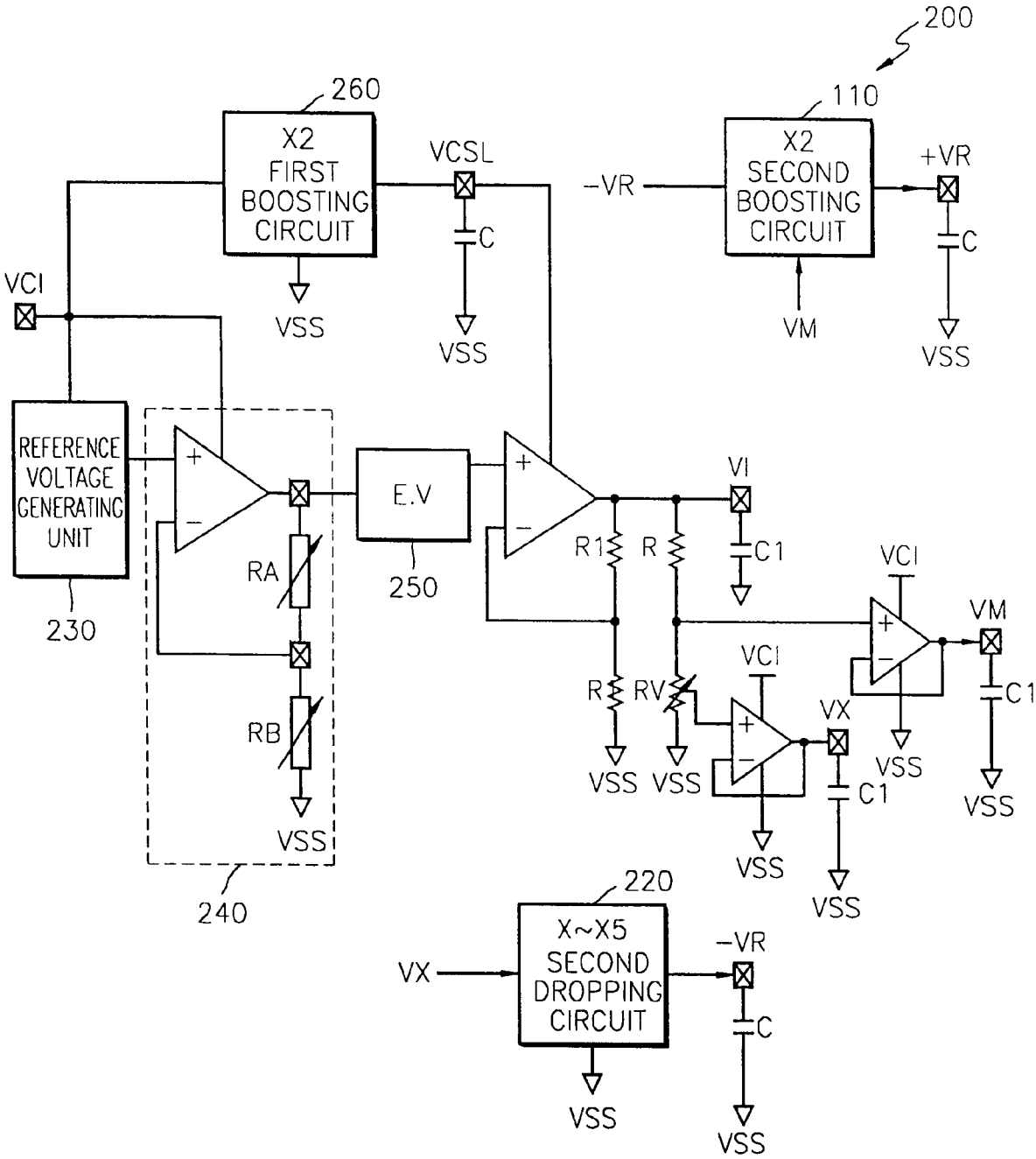
FIG. 2 is a circuit diagram of an STN LCD driver using a three-line selection method.
Figure 3:
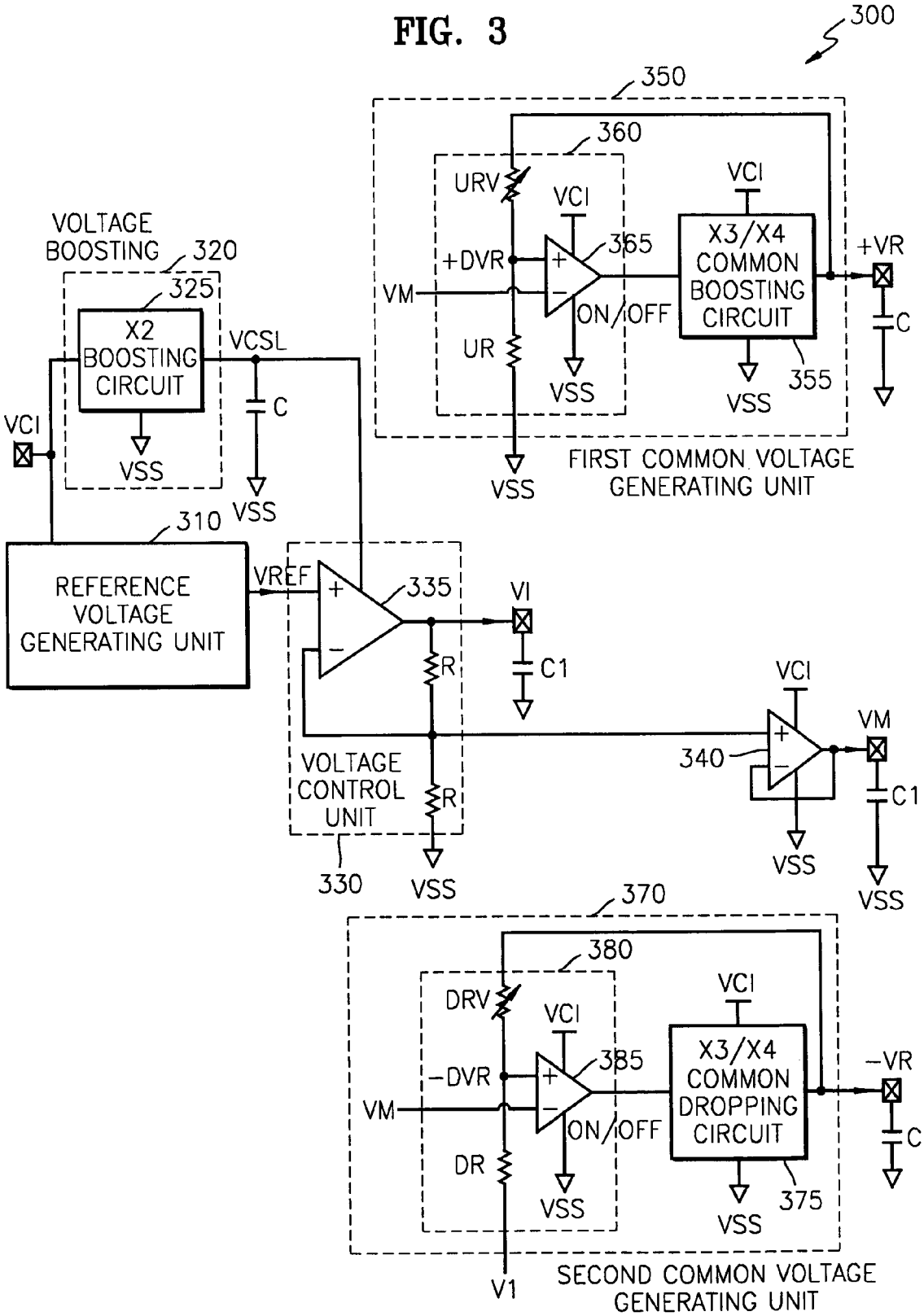
FIG. 3 is a circuit diagram of an STN LCD according to a first embodiment of the present invention.

FIG. 3 is a circuit diagram of an STN LCD according to a first embodiment of the present invention.

Referring to FIG. 3, an STN LCD driver 300 includes a reference voltage generating circuit 310, a voltage boosting unit 320, a voltage control unit 330, a first common voltage generating unit 350, and a second common voltage generating unit 370.

The reference voltage generating unit 310 generates a reference voltage VREF in response to an external voltage VCI. The voltage control unit 330 generates a first segment voltage VM and a second segment voltage V1 which drive a segment electrode of an STN LCD panel (not shown) in response to the reference voltage VREF and a boosting voltage VCSL.

The voltage control unit 330 receives the reference voltage VREF into its positive input end and includes a comparator 335 controlled by the boosting voltage VCSL and resistances R. The comparator 335 outputs the second segment voltage V1, and the level of the first segment voltage VM is obtained by dividing voltage levels between the second segment voltage V1 and a ground voltage VSS equally by resistances R.

The boosting voltage VCSL is outputted from the voltage boosting unit 320 which receives and boosts the external voltage VCI. The voltage boosting unit 320 includes a boosting circuit 325. The boosting circuit 325 can boost the external voltage VCI to K times the external voltage VCI where (K is a natural number). In one embodiment of the present invention, K is 2.

The boosting circuit 325 includes a charge capacitor (not shown) therein. A capacitor C, which is connected to an output end of the boosting circuit 325, is connected to outside the STN LCD driver 300. A general boosting circuit includes a charge capacitor and a storage capacitor. That is, in the present invention, the charge capacitor is included inside the boosting circuit 325, and the storage capacitor is placed outside the boosting circuit 325.

The first common voltage generating unit 350 drives a common electrode of the STN LCD panel in response to the external voltage VCI, the ground voltage VSS, and the first segment voltage VM and generates the first common voltage +VR which has a voltage level higher than the voltage level of the first segment voltage VM.

More specifically, the first common voltage generating unit 350 includes a common boosting circuit 355, which generates the first common voltage +VR in response to the external voltage VCI and the ground voltage VSS, and a boosting comparing circuit 360 which turns on the common boosting circuit 355 if the voltage level of a first common division voltage +DVR is lower than the voltage level of the first segment voltage VM and turns off the common boosting circuit 355 if the voltage level of the first common division voltage +DVR is higher than the voltage level of the first segment voltage VM.

The voltage level of the first common division voltage +DVR is obtained by dividing the voltage level of the first common voltage +VR by a predetermined resistance ratio.

Since the external voltage VCI and the ground voltage VSS are used to generate the first common voltage +VR differently from a conventional STN LCD driver, it is possible to to avoid the effect of loads of the STN LCD panel to the LCD driver. In addition, it is possible to improve the driving capacity of the first common voltage +VR by using the external voltage VCI.

The common boosting circuit 355 can be turned on or off by using the boosting comparing circuit 360, and the voltage level of the first common voltage +VR can be controlled by using the ratio of a boosting adjustable resistance URV to a boosting resistance UR of the boosting comparing circuit 360.

The common boosting circuit 355 includes the charge capacitor. The first segment voltage VM is connected to a negative input end of the boosting comparing circuit 360, and the first common division voltage +DVR is connected to a positive input end of the boosting comparing circuit 360. The boosting comparing circuit 360 includes a boosting comparator 365, an output of which turns on or off the common boosting circuit 355, the boosting adjustable resistance URV which is connected between an output end of the common boosting circuit 355 and the positive input end of the boosting comparator 365, and a boosting resistance UR which is connected between the positive input end of the boosting comparator 365 and the ground voltage VSS.

Hereinafter, operation of the boosting comparing circuit 360 will be described. If, due to an increase in loads of the STN LCD panel (not shown), the voltage level of the first common voltage +VR is lower than a voltage level required, the voltage level of the first common division voltage +DVR is lowered.

If the boosting adjustable resistance URV is equal to the boosting resistance UR, the voltage level of the first common division voltage +DVR is half the voltage level of the first common voltage +VR. If the voltage level of the first common voltage +VR is lowered, the voltage level of the first common division voltage +DVR is lowered also.

If the voltage level of the first common division voltage +DVR is lower than the voltage level of the first segment voltage VM, the boosting comparator 365 turns on the common boosting circuit 355. If the common boosting circuit 355 is turned on, the voltage level of the first common voltage +VR is increased.

If the voltage level of the common division voltage +DVR is higher than the voltage level of the first segment voltage VM, the boosting comparator 365 turns off the common boosting circuit 355. If the common boosting circuit 355 is turned off, the voltage level of the first common voltage +VR is lowered. Thus, the voltage level of the first common voltage +VR can be maintained at a certain level by using the boosting comparing circuit 360.

The voltage level of the first common voltage +VR can be controlled in various ways by using a resistance ratio of the boosting adjustable resistance URV to the boosting resistance UR. If the loads from the STN LCD panel (not shown) are reduced, power consumption can be reduced by turning off the common boosting circuit 355.

The second common voltage generating unit 370 drives a common electrode of the STN LCD panel in response to the external voltage VCI, the ground voltage VSS, and the first segment voltage VM and generates a second common voltage −VR, the voltage level of which is lower than the first segment voltage VM, by using a predetermined resistance ratio.

The second common voltage generating unit 370 includes a common dropping circuit 375, which generates the second common voltage −VR in response to the external voltage VCI and the ground voltage VSS, and a dropping comparing circuit 380, which turns on the common dropping circuit 375 if the voltage level of a second common division voltage −DVR is higher than the voltage level of the first segment voltage VM and turns off the common dropping circuit 375 if the voltage level of the second common division voltage −DVR is lower than the voltage level of the first segment voltage VM.

The voltage level of the second common division voltage −DVR is generated by dividing the voltage level of the second common voltage −VR by a predetermined resistance ratio.

Since the second common voltage generating unit 370 is controlled in response to the external voltage VCI and the ground voltage VSS similarly to the first common voltage generating unit 350, it is possible to avoid the effect of loads of the STN LCD panel. In addition, it is possible to improve the driving capacity of the second common voltage −VR by using the external voltage VCI.

In addition, the common dropping circuit 375 can be turned on or off by using the dropping comparing circuit 380, and the voltage level of the second common voltage −VR can be controlled by using the resistance ratio of the dropping adjustable resistance DRV to the dropping resistance DR of the dropping comparing circuit 380.

The common dropping circuit 375 includes a charge capacitor therein. A negative input end of the dropping comparing circuit 380 is connected to the first segment voltage VM, and a positive input end of the dropping comparing circuit 380 is connected to the second common division voltage −DVR. The dropping comparing circuit 380 includes the dropping comparator 385, the dropping adjustable resistance DRV, and the dropping resistance DR. The output of the dropping comparator 385 turns on or off the common dropping circuit 375. The dropping adjustable resistance DRV is connected between an output end of the common dropping circuit 375 and the positive input end of the dropping comparator 385. The dropping resistance DR is connected between the positive input end of the dropping comparator 385 and the second segment voltage V1.

Hereinafter, operation of the dropping comparing circuit 380 will be described. As the voltage level of the second common voltage −VR becomes high, the voltage level of the second common division voltage −DVR becomes high. If the voltage level of the second common division voltage −DVR becomes higher than the voltage level of the first segment voltage VM, the dropping comparator 385 turns on the common dropping circuit 375. If the common dropping circuit 375 is turned on, the voltage level of the second common voltage −VR is lowered.

If the voltage level of the second common division voltage −DVR is lower than the voltage level of the first segment voltage VM, the dropping comparator 385 turns off the common dropping circuit 375. If the common dropping circuit 375 is turned off, the voltage level of the second common voltage −VR becomes high. Thus, the voltage level of the second common voltage −VR can be maintained at a certain level by using the dropping comparing circuit 380.

Also, the voltage level of the second common voltage −VR can be controlled in various ways by using the ratio of the dropping adjustable resistance DRV to the dropping resistance DR. If loads to the STN LCD panel (not shown) are reduced, the common dropping circuit 375 can be turned off, and thus power consumption can be reduced.

The STN LCD driver 300 of FIG. 3 includes only five external capacitors. That is, the STN LCD driver 300 includes three external capacitors C in the boosting circuit 325, the common boosting circuit 355, and the common dropping circuit 375 and two bias capacitors C1 used to stabilize the first segment voltage VM and the second segment voltage V1. Therefore, the number of the external capacitors of the STN LCD driver according to the present invention is much less than the external capacitors of a conventional STN LCD driver.

The STN LCD driver 300 of FIG. 3 can use various bias ratios between the first common voltage +VR and the second common voltage −VR by controlling the ratio of the boosting adjustable resistance URV to the boosting resistance UR and the ratio of the dropping adjustable resistance DRV to the dropping resistance DR. Since the voltage level of the second voltage V1 is maintained to be double the voltage level of the first segment voltage VM, the second voltage V1 can be safely generated.

If the voltage level of the first segment voltage VM is lowered, the voltage level of the second segment voltage V1 is also lowered. Also, the voltage levels of the first common voltage +VR and the second common voltage −VR are lowered, thus the difference between the voltage levels of the first segment voltage VM and first common voltage +VR is equal to the difference between the voltage levels of the first segment voltage VM and second common voltage −VR, enabling the quality of the display of the STN LCD panel (not shown) to be improved.

Figure 4:
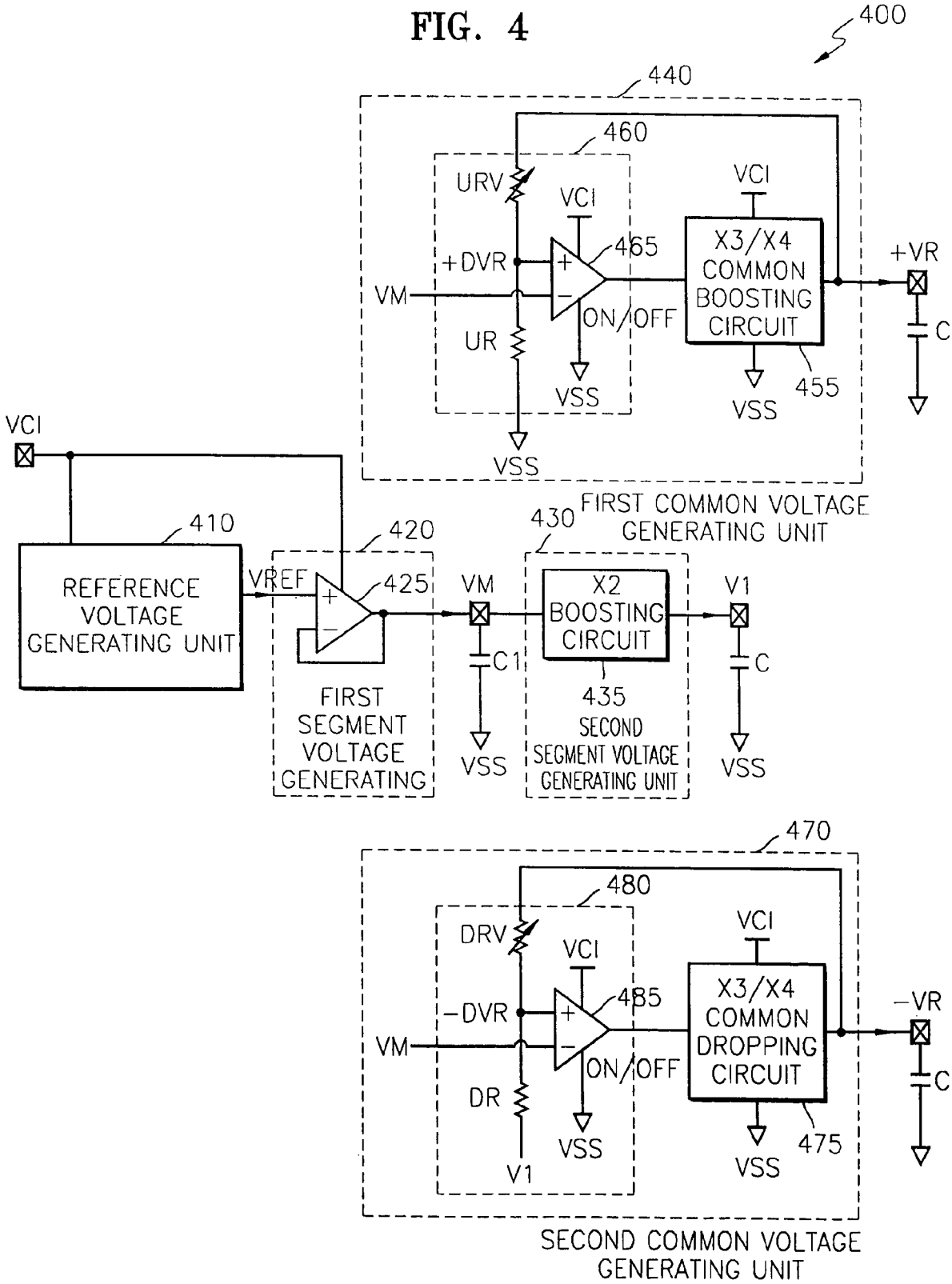
FIG. 4 is a circuit diagram of an STN LCD according to a second embodiment of the present invention.

FIG. 4 is a circuit diagram of an STN LCD according to a second embodiment of the present invention.

Referring to FIG. 4, an STN LCD driver 400 includes a reference voltage generating unit 410, a first segment voltage generating unit 420, a second segment voltage generating unit 430, a first common voltage generating unit 440, and a second common voltage generating unit 470.

The reference voltage generating unit.410, the first common voltage generating unit 440, and the second common voltage generating unit 470 respectively have the same configuration as the reference voltage generating unit 310, the first common voltage generating unit 350, and the second common voltage generating unit 370 of the STN LCD driver 300. Therefore, description of their operation will not be repeated here.

A first segment voltage generating unit 420 receives a reference voltage VREF in response to an external voltage VCI and generates a first segment voltage VM which drives a segment electrode of an STN LCD panel. The first segment voltage generating unit 420 includes a voltage follower 425 a positive input end of which receives the reference voltage VREF and which is controlled by the external voltage VCI.

The voltage follower 425 outputs the first segment voltage VM. The voltage follower 425 generates the first segment voltage VM not by boosting the external voltage VCI with the voltage boosting unit 320 as described in FIG. 3, but by directly using the external voltage VCI as a control voltage.

A second segment voltage generating unit 430 generates the second segment voltage V1 which is generated by boosting the first segment voltage VM. More specifically, the second segment voltage generating unit 430 includes a boosting circuit 435, which has a charge capacitor, and receives and boosts the first segment voltage VM.

The STN LCD driver 400 of FIG. 4 has all the advantages of the STN LCD driver 300 of FIG. 3. It is not necessary to generate a high voltage such as the boosting voltage VCSL of the STN LCD driver 300 of FIG. 3 because the second segment voltage V1 is generated by boosting the first segment voltage VM.

Therefore, power consumption can be reduced, and only four external capacitors are required. That is, the STN LCD driver 400 includes three external capacitors C in a common boosting circuit 455, a common dropping circuit 475, and the boosting circuit 435, and one bias capacitor C1 used to stabilize the first segment voltage VM.

Figure 5:
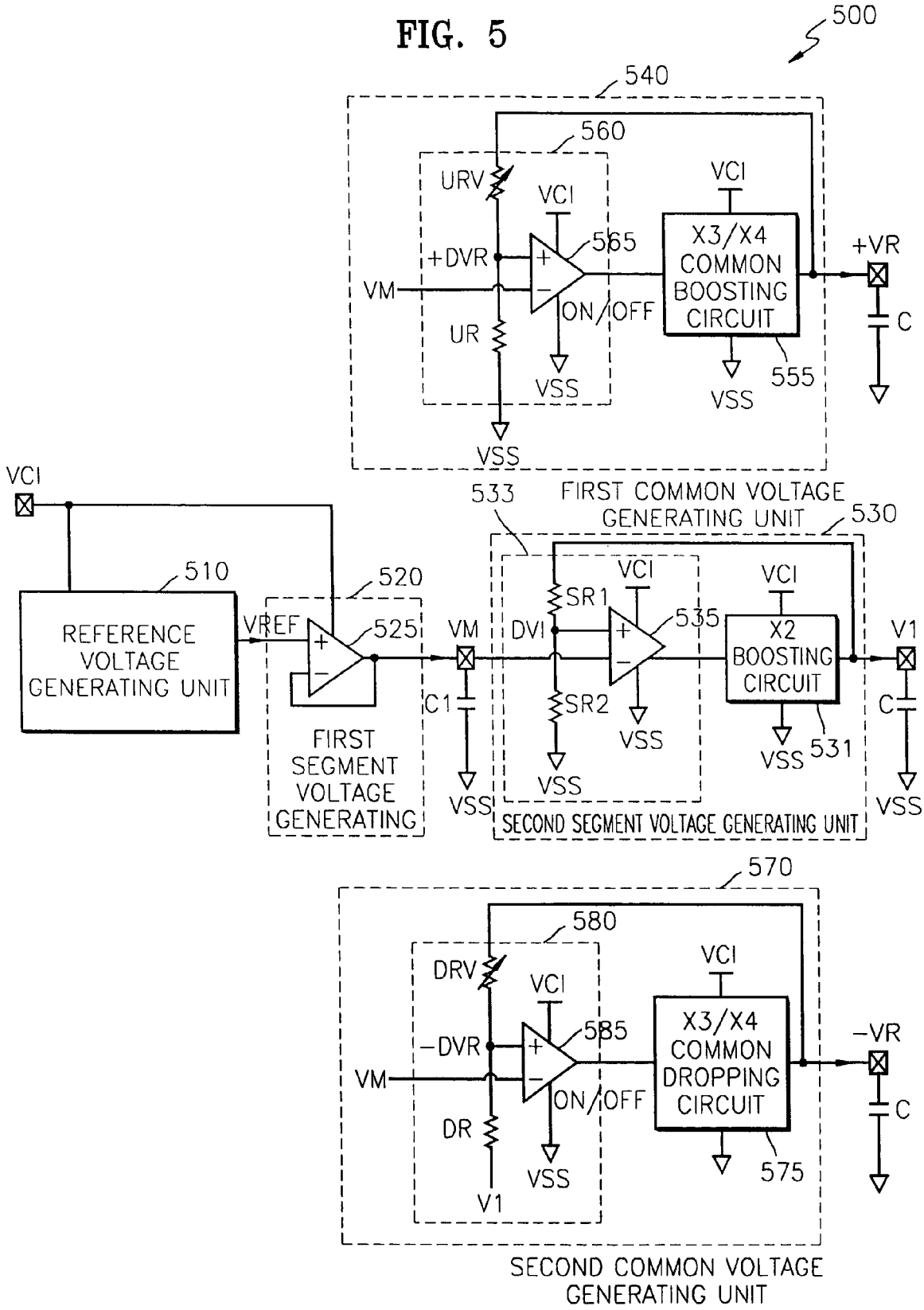
FIG. 5 is a circuit diagram showing a segment voltage comparing circuit further included in the STN LCD driver of FIG. 4.

FIG. 5 is a circuit diagram showing a segment voltage comparing circuit further included in the STN LCD driver 400 of FIG. 4.

An STN LCD driver 500 of FIG. 5 is different from the STN LCD driver 400 only in the configuration of a second segment voltage generating unit 530. Therefore, the STN LCD driver 500 will be described based on its differences from the STN LCD driver 400 of FIG. 4.

Referring to FIG. 5, the second segment voltage generating unit 530 includes a boosting circuit 531 and a segment voltage comparing circuit 533. The boosting circuit 531 is same as the boosting circuit 435 of FIG. 4. That is, a second segment voltage V1 is generated by boosting a first segment voltage VM.

The segment voltage comparing circuit 533 turns off the boosting circuit 531 if the voltage level of a segment division voltage DV1 is higher than the voltage level of the first segment voltage VM, and turns on the boosting circuit 531 if the voltage level of the segment division voltage DV1 is lower than the voltage level of the first segment voltage VM.

More specifically, a negative input end of the segment voltage comparing circuit 533 is connected to the first segment voltage VM, and a positive input end of the segment voltage comparing circuit 533 is connected to the segment division voltage DV1. The segment voltage comparing circuit 533 includes a segment voltage comparator 535, an output of which turns on or off the boosting circuit 531, a first segment resistance SR1 which is connected between an output end of the boosting circuit 531 and a positive input end of the segment voltage comparator 535, and a second segment resistance SR2 which is connected between the positive input end of the segment voltage comparator 535 and a ground voltage VSS.

The first segment resistance SR1 and the second segment resistance SR2 have the same resistance value. Consequently, the voltage level of the second segment voltage V1 becomes double the voltage level of the first segment voltage VM.

The segment division voltage DV1 is generated by dividing the second segment voltage V1 with the ratio of the first segment resistance SR1 to the second segment resistance SR2. Therefore, if the voltage level of the second segment voltage V1 becomes high, the voltage level of the segment division voltage DV1 becomes high. If the voltage level of the second segment voltage V1 becomes low, the voltage level of the segment division voltage DV1 becomes low also.

The segment voltage comparing circuit 533 turns on or off the boosting circuit 531 in the same way as the boosting comparing circuit 560 or the dropping comparing circuit 580. Therefore, description of the operation of the segment voltage comparing circuit 533 will not be repeated here. The STN LCD driver 500 of FIG. 5 has the same advantages as the STN LCD driver 400 of FIG. 4 and can control the boosting circuit 531 of the second segment voltage generating unit 530, enabling the power consumption to be reduced.

Figure 6:
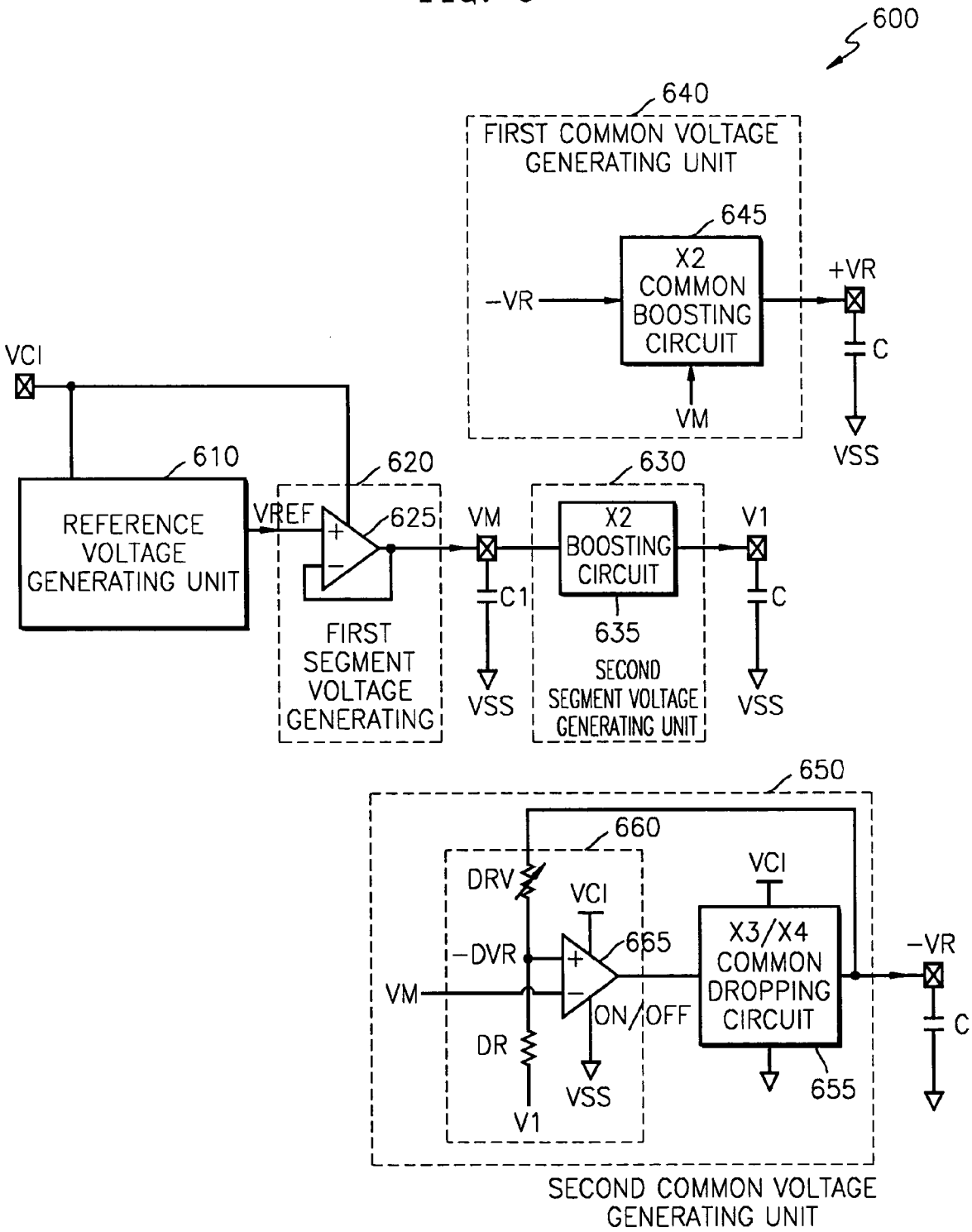
FIG. 6 is a circuit diagram of an STN LCD according to a third embodiment of the present invention.

FIG. 6 is a circuit diagram of an STN LCD 600 according to a third embodiment of the present invention.

Referring to FIG. 6, the STN LCD driver 600 includes a reference voltage generating unit 610, a first segment voltage generating unit 620, a second segment voltage generating unit 630, a first common voltage generating unit 640, and a second common voltage generating unit 650.

The STN LCD driver 600 of FIG. 6 is different from the STN LCD driver 400 of FIG. 4 only in the configuration of the first common voltage generating unit 640. Therefore, the STN LCD driver 600 will be described based on its differences from the STN LCD driver 400.

The first common voltage generating unit 640 drives a common electrode of the STN LCD panel (not shown) in response to a second common voltage −VR and a first segment voltage VM and generates a first common voltage +VR having a voltage level that is N (where N is an integer) times the difference of the second common voltage −VR from the first segment voltage VM.

The first common voltage generating unit 640 includes a common boosting circuit 645. The common boosting circuit 645 generates the first common voltage +VR by boosting the voltage level of the difference of the second common voltage −VR from the first segment voltage VM to N times the voltage level of the difference. In one embodiment, N is 2.

Then, the voltage level of the first common voltage +VR becomes symmetrical based on the voltage level of the first segment voltage VM. Thus, if the voltage level of the first segment voltage VM is changed, the voltage levels of the first common voltage +VR and the second common voltage −VR are changed also. Therefore, the voltage levels of the first common voltage +VR and the first segment voltage VM are maintained to be symmetrical to each other. Thus, the display quality of the STN LCD panel (not shown) can be improved.

In addition, the number of external capacitors can be reduced to four. Since the voltage level of the second common voltage −VR can be controlled in various ways by using the ratio of a dropping adjustable resistance DRV to a dropping resistance DR, the voltage level of the first common voltage +VR can be controlled.

Figure 7:
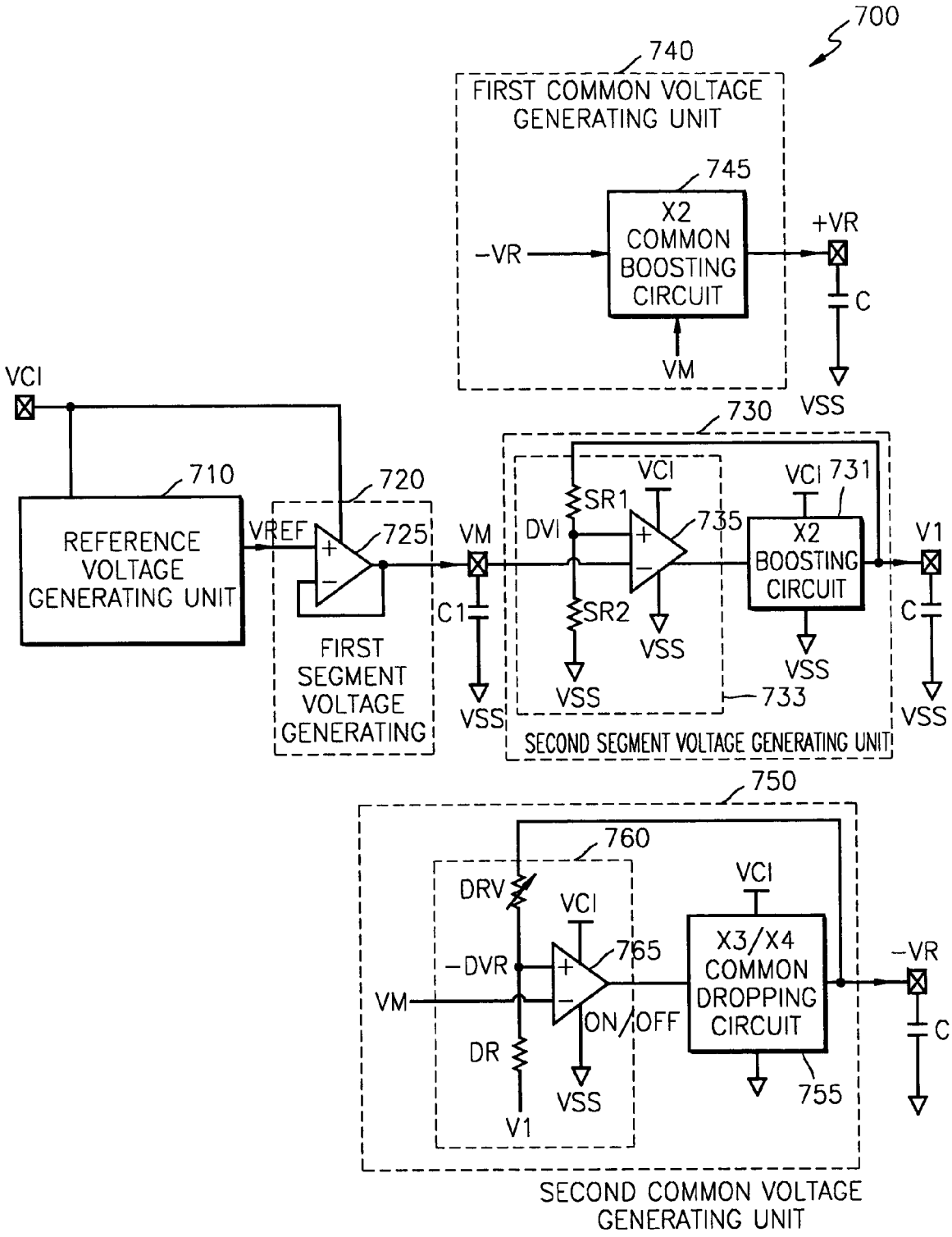
FIG. 7 is a circuit diagram of a segment voltage comparing circuit further included in the STN LCD driver of FIG. 6.

FIG. 7 is a circuit diagram of a segment voltage comparing circuit further included in the STN LCD driver of FIG. 6.

An STN LCD driver 700 of FIG. 7 is different from the STN LCD driver 600 of FIG. 6 only in the configuration of a second segment voltage generating unit 730. Therefore, the STN LCD driver 700 will be described based on its differences from the STN LCD driver 600.

Referring to FIG. 7, the second segment voltage generating unit 730 includes a boosting circuit 731 and a segment voltage comparing circuit 733. The boosting circuit 731 is the same as the boosting circuit 635 of FIG. 6. That is, the boosting circuit 731 generates a second segment voltage V1 by boosting a first segment voltage VM.

The segment voltage comparing circuit 733 turns off the boosting circuit 731 if the voltage level of a segment division voltage DV1 is higher than the voltage level of a first segment voltage VM, and turns on the boosting circuit 731 if the voltage level of the segment division voltage DV1 is lower than the voltage level of the first segment voltage.

More specifically, the segment voltage comparing circuit 733 includes a segment voltage comparator 735, a first segment resistance SR1, and a second segment resistance SR2.

A negative input end of the segment voltage comparator 735 is connected to a first segment voltage VM, and a positive input end of the segment voltage comparator 735 is connected to a segment division voltage DV1. An output of the segment voltage comparator 735 turns on or off the boosting circuit 731. The first segment resistance SR1 is connected between an output end of the boosting circuit 731 and the positive input end of the segment voltage comparator 735. The second segment resistance SR2 is connected between the positive input end of the segment voltage comparator 735 and the ground voltage VSS.

The voltage level of the second segment voltage V1 can be controlled by controlling the ratio of the first segment resistance SR1 to the second segment resistance SR2. In the present invention, the first segment resistance SR1 and the second segment resistance SR2 have the same resistance value. Consequently, the voltage level of the second segment voltage V1 can be double the voltage level of the first segment voltage VM.

The segment division voltage DV1 is generated by dividing the second segment voltage V1 with the ratio of the first segment resistance SR1 to the second segment resistance SR2. Therefore, if the voltage level of the second segment voltage V1 becomes high, the voltage level of the segment division voltage DV1 becomes high. If the voltage level of the second segment voltage V1 becomes low, the voltage level of the segment division voltage DV1 becomes low also.

The segment voltage comparing circuit 733 turns on or off the boosting circuit 731 in the same way as the boosting comparing circuit 760. Therefore, description of the operation of the segment voltage comparing circuit 733 will not be repeated here. The STN LCD driver 700 of FIG. 7 has the same advantages as the STN LCD driver 600 of FIG. 6 and can control the boosting circuit 731 of the second segment voltage generating unit 730, enabling the power consumption to be reduced.

Figure 8:
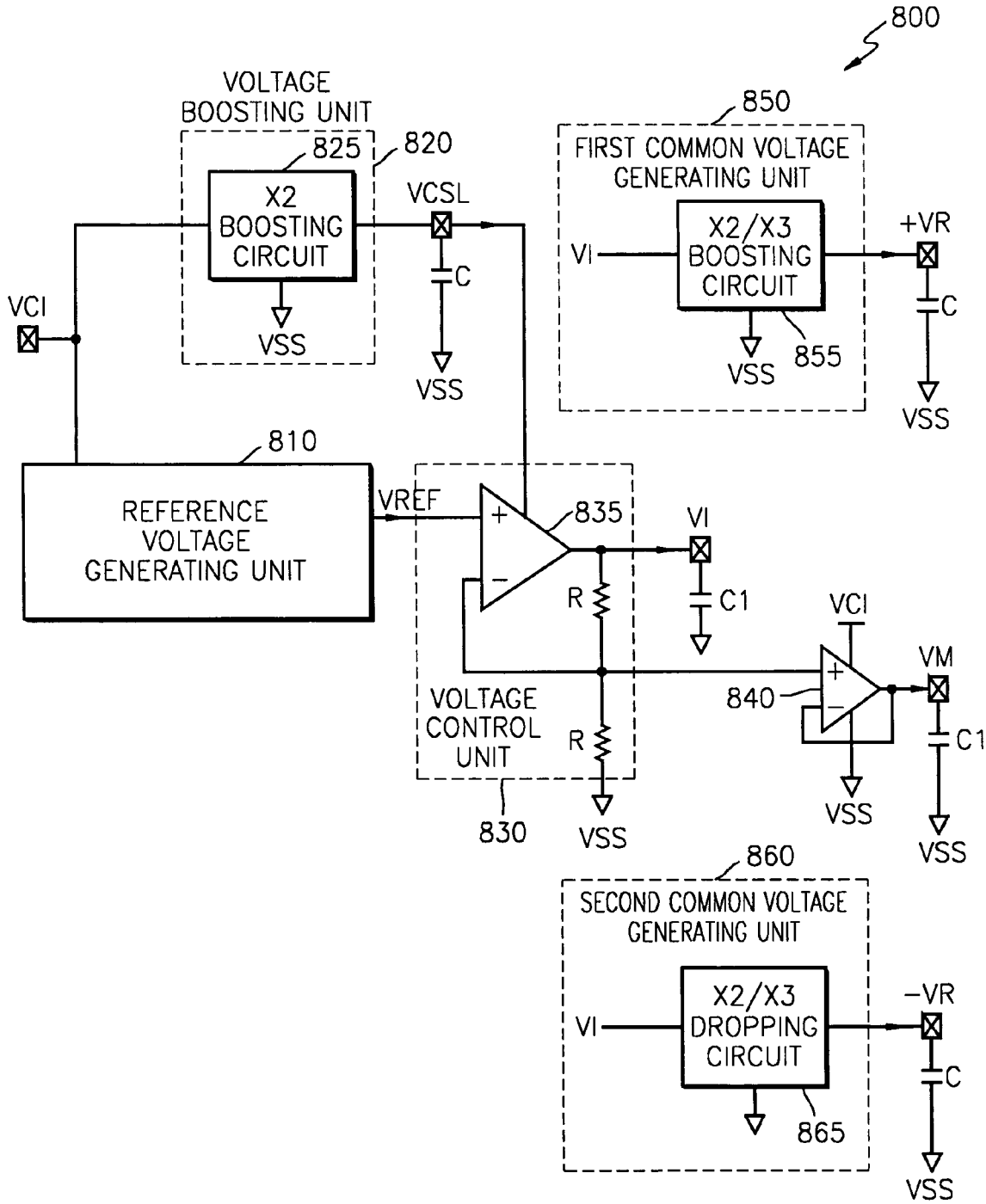
FIG. 8 is a circuit diagram of an STN LCD driver according to a fourth embodiment of the present invention.

FIG. 8 is a circuit diagram of an STN LCD driver according to a fourth embodiment of the present invention.

Referring to FIG. 8, an STN LCD driver 800, includes a reference voltage generating unit 810, a voltage boosting unit 820, a voltage control unit 830, a first common voltage generating unit 850, and a second common voltage generating unit 860.

The reference voltage generating unit 810 generates a reference voltage VREF in response to an external voltage VCI. The voltage boosting unit 820 generates a boosting voltage VCSL, which is generated by boosting the external voltage VCI. The voltage control unit 830 generates a first segment voltage VM and a second segment voltage V1 which drive a segment electrode of the STN LCD panel (not shown) in response to the reference voltage VREF and the boosting voltage VCSL.

A positive input end of the voltage control unit 830 receives the reference voltage VREF and includes a comparator 835, which is controlled by using the boosting voltage VCSL, and resistances R. The comparator 835 outputs the second segment voltage V1, and the voltage level of the first segment voltage VM is generated by equally dividing the voltage levels between the second segment voltage V1 and the ground voltage VSS.

The voltage levels between the second segment voltage V1 and the ground voltage VSS are equally divided by resistances R. Since the resistances R have the same resistance value, the voltage level of the second segment voltage V1 becomes double the voltage level of the first segment voltage VM.

The boosting voltage VCSL is outputted from the voltage boosting unit 820 which receives and boosts the external voltage VCI. The voltage boosting unit 820 includes a boosting circuit 825. The boosting circuit 825 can boost an inputted external voltage VCI to K (where K is a natural number) times the external voltage VCI. In this embodiment, K is 2. The boosting circuit 825 includes a charge capacitor therein.

The first common voltage generating unit 850 drives a common electrode of the STN LCD panel (not shown) in response to the ground voltage VSS and the second segment voltage V1 and generates a first common voltage +VR having the voltage level that is M (where M is an integer) times the difference of the voltage level of the ground voltage VSS from the voltage level of the second segment voltage V1.

The first common voltage generating unit 850 includes a boosting circuit 855. The boosting circuit 855 includes a charge capacitor (not shown) therein.

The second common voltage generating unit 860 drives a common electrode of the STN LCD panel (not shown) in response to the ground voltage VSS and the second segment voltage V1 and generates a second common voltage −VR having the voltage level that is 1/M times the difference of the voltage level of the ground voltage VSS from the voltage level of the second segment voltage V1.

The STN LCD driver 800 of FIG. 8 continues turning on the boosting circuit 855 of the first common voltage generating unit 850 and a dropping circuit 865 of the second common voltage generating unit 860 even though loads to the STN LCD panel (not shown) are reduced. However, the STN LCD driver 800 requires less external capacitors than the conventional STN LCD driver.

The STN LCD driver 800 includes two external capacitors in the boosting circuit 855 of the first common voltage boosting unit 850 and the dropping circuit 865 of the second common voltage generating unit 860. The STN LCD driver 800 includes two bias capacitors which are respectively used to stabilize the first segment voltage VM and the second segment voltage V1. The STN LCD driver 800 requires a total of five external capacitors, which is less than the number of external capacitors required in the conventional STN LCD driver.

In the embodiments of the present invention, the STN LCD driver using a three-line selection method is described. However, the present invention can be applied to an STN LCD driver using a four-line selection method or a multi line selection method.

As described above, an STN LCD driver according to the present invention can reduce the number of external capacitors and minimize power consumption.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A super twist nematic (STN) liquid crystal display (LCD) driver which drives a STN LCD panel, the STN LCD driver comprising:

a reference voltage generating unit which generates a reference voltage in response to an external voltage;

a voltage boosting unit which generates a boosting voltage by boosting the external voltage;

a voltage control unit which generates a first segment voltage and a second segment voltage which drive a segment electrode of the STN LCD panel in response to the reference voltage and the boosting voltage;

a first common voltage generating unit which drives a common voltage of the STN LCD panel in response to the external voltage, a ground voltage, and the first segment voltage and generates a first common voltage, the voltage level of which is higher than the voltage level of the first segment voltage, using a predetermined resistance ratio; and a second common voltage generating unit which drives a common voltage of the STN LCD panel in response to the external voltage, the ground voltage, and the first segment voltage and generates a second common voltage, the voltage level of which is lower than the voltage level of the first segment voltage, using a predetermined resistance ratio.

2. The STN LCD driver of claim 1, wherein the voltage boosting unit includes a boosting circuit, which has a charge capacitor, and receives and boosts the external voltage.

3. The STN LCD driver of claim 1, wherein the first common voltage generating unit comprises:

a common boosting circuit which generates the first common voltage in response to the external voltage and the ground voltage; and a boosting comparing circuit which turns off the common boosting circuit if the voltage level of a first common division voltage is higher than the voltage level of the first segment voltage and turns on the common boosting circuit if the voltage level of the first common division voltage is lower than the voltage level of the first segment voltage, wherein the voltage level of the first common division voltage is generated by dividing the voltage level of the first common voltage using a predetermined resistance ratio.

4. The STN LCD driver of claim 3, wherein the boosting comparing circuit comprises:

a boosting comparator which has a negative input end connected to the first segment voltage, a positive input end connected to the first common division voltage, and an output end that turns on or off the common boosting circuit;

a boosting adjustable resistance which is connected between an output end of the common boosting circuit and the positive input end of the boosting comparator; and a boosting resistance which is connected between the positive input end of the boosting comparator and the ground voltage.

5. The STN LCD driver of claim 3, wherein the common boosting circuit includes a charge capacitor therein.

6. The STN LCD driver of claim 1, wherein the second common voltage generating unit comprises:

a common dropping circuit which generates the second common voltage in response to the external voltage and the ground voltage; and a dropping comparing circuit which turns on the common dropping circuit if the voltage level of a second common division voltage is higher than the voltage level of the first segment voltage and turns off the common dropping circuit if the voltage level of the second common division voltage is lower than the voltage level of the first segment voltage, wherein the voltage level of the second common division voltage is generated by dividing the voltage level of the second common voltage using a predetermined resistance ratio.

7. The STN LCD driver of claim 6, wherein the dropping comparing circuit comprises:

a dropping comparator which has a negative input end connected to the first segment voltage, a positive input end connected to the second common division voltage, and an output end that turns on or off the common dropping circuit;

a dropping adjustable resistance which is connected between an output end of the common dropping circuit and the positive input end of the dropping comparator; and a dropping resistance which is connected between the positive input end of the dropping comparator and the second segment voltage.

8. The STN LCD driver of claim 6, wherein the common dropping circuit includes a charge capacitor therein.

9. A super twist nematic (STN) liquid crystal display (LCD) driver which drives an STN LCD panel, the STN LCD driver comprising:

a reference voltage generating unit which generates a reference voltage in response to an external voltage;

a first segment voltage generating unit which receives the reference voltage in response to the external voltage and generates a first segment voltage which drives a segment electrode of the STN LCD panel;

a second segment voltage generating unit which generates a second segment voltage by boosting the first segment voltage;

a first common voltage generating unit which drives a common electrode of the STN LCD panel in response to the external voltage, the ground voltage, and the first segment voltage and generates a first common voltage, the voltage level of which is higher than the voltage level of the first segment voltage, using a predetermined resistance ratio; and a second common voltage generating unit which drives a common electrode of the STN LCD panel in response to the external voltage, the ground voltage, and the first segment voltage and generates a second common voltage, the voltage level of which is higher than the voltage level of the first segment voltage, using a predetermined resistance ratio.

10. The STN LCD driver of claim 9, wherein the second segment voltage generating unit comprises a boosting circuit, which has a charge capacitor, and receives and boosts the first segment voltage.

11. The STN LCD driver of claim 9, wherein the second segment voltage generating unit further comprises a segment voltage comparing circuit which turns off the boosting circuit if the voltage level of a segment division voltage is higher than the voltage level of the first segment voltage and turns on the boosting circuit if the voltage level of the segment division voltage is lower than the voltage level of the first segment voltage, wherein the voltage level of the segment division level is generated by dividing the voltage level of the second segment voltage using a predetermined resistance ratio.

12. The STN LCD driver of claim 11, wherein the segment voltage comparing circuit further comprises:

a segment voltage comparator which has a negative input end connected to the first segment voltage, a positive input end connected to the segment division voltage, and an output end that turns on or off the boosting circuit;

a first segment resistance which is connected between an output end of the boosting circuit and the positive input end of the segment voltage comparator; and a second segment resistance which is connected between the positive input end of the segment voltage comparator and the ground voltage.

13. The STN LCD driver of claim 9, wherein the first common voltage generating unit further comprises:

a common boosting circuit which generates the first common voltage in response to the external voltage and the ground voltage; and a boosting comparing circuit which turns off the common boosting circuit if the voltage level of a first common division voltage is higher than the voltage level of the first segment voltage and turns on the common boosting circuit if the voltage level of the first common division voltage is lower than the voltage level of the first segment voltage, wherein the voltage level of the first common division voltage is generated by dividing the voltage level of the first common voltage using a predetermined resistance ratio.

14. The STN LCD driver of claim 13, wherein the boosting comparing circuit comprises:

a boosting comparator which has a negative input end connected to the first segment voltage, a positive input end connected to the first common division voltage, and an output end that turns on or off the common boosting circuit;

a boosting adjustable resistance which is connected between an output end of the common boosting circuit and the positive input end of the boosting comparator; and a boosting resistance which is connected between the positive input end of the boosting comparator and the ground voltage.

15. The STN LCD driver of claim 13, wherein the common boosting circuit includes a charge capacitor therein.

16. The STN LCD driver of claim 9, wherein the second common voltage generating unit comprises:

a common dropping circuit which generates the second common voltage in response to the external voltage and the ground voltage; and a dropping comparing circuit which turns on the common dropping circuit if the voltage level of a second common division voltage is higher than the voltage level of the first segment voltage and turns off the common boosting circuit if the voltage level of the second common division voltage is lower than the voltage level of the first segment voltage, wherein the voltage level of the second common division voltage is generated by dividing the voltage level of the second common voltage using a predetermined resistance ratio.

17. The STN LCD driver of claim 16, wherein the dropping comparing circuit comprises:

a dropping comparator which has a negative input end connected to the first segment voltage, a positive input end connected to the second common division voltage, and an output end that turns on or off the common dropping circuit;

a dropping adjustable resistance which is connected between an output end of the common dropping circuit and the positive input end of the dropping comparator; and a dropping resistance which is connected between the positive input end of the dropping comparator and the second segment voltage.

18. The STN LCD driver of claim 16, wherein the common dropping circuit includes a charge capacitor therein.

19. A super twist nematic (STN) liquid crystal display (LCD) driver which drives an STN LCD panel, the STN LCD driver comprising:

a reference voltage generating unit which generates a reference voltage in response to an external voltage;

a first segment voltage generating unit which receives the reference voltage in response to the external voltage and generates a first segment voltage driving a segment electrode of the STN LCD panel;

a second segment voltage generating unit which generates a second segment voltage by boosting the first segment voltage;

a first common voltage generating unit which drives a common electrode of the STN LCD panel in response to a second common voltage and the first segment voltage and generates a first common voltage having a voltage level that is N (where N is an integer) times the difference of the voltage level of the second common voltage from the voltage level of the first segment voltage; and a second common voltage generating unit which drives a common electrode of the STN LCD panel in response to the external voltage, the ground voltage, and the first segment voltage and generates the second common voltage having a voltage level that is lower than the voltage level of the first segment voltage using a predetermined resistance ratio.

20. The STN LCD driver of claim 19, wherein the second segment voltage generating unit comprises a boosting circuit, which has a charge capacitor therein, and receives and boosts the first segment voltage.

21. The STN LCD driver of claim 19, wherein the second segment voltage generating unit further comprises a segment voltage comparing circuit which turns off the boosting circuit if the voltage level of a segment division voltage is higher than the voltage level of the first segment voltage and turns on the boosting circuit if the voltage level of the segment division voltage is lower than the voltage level of the first segment voltage, wherein the voltage level of the segment division voltage is generated by dividing the voltage level of the segment voltage using a predetermined resistance ratio.

22. The STN LCD drive of claim 21, wherein the segment voltage comparing circuit comprises:

a segment voltage comparator which has a negative input end connected to the first segment voltage, a positive input end connected to the segment division voltage, and an output end that turns on or off the boosting circuit;

a first segment resistance which is connected between an output end of the boosting circuit and the positive input end of the segment voltage comparator; and a second segment resistance which is connected between the positive input end of the segment voltage comparator and the ground voltage.

23. The STN LCD drive of claim 19, wherein the second common voltage generating unit comprises:

a common dropping circuit which generates the second common voltage in response to the external voltage and the ground voltage; and a dropping comparing circuit which turns on the common dropping circuit if the voltage level of a common division voltage is higher than the voltage level of the first segment voltage and turns off the common dropping circuit if the voltage level of the common division voltage is lower than the voltage level of the first segment voltage, wherein the voltage level of the common division voltage is generated by dividing the voltage level of the second common voltage using a predetermined resistance ratio.

24. The STN LCD driver of claim 23, wherein the dropping comparing circuit comprises:

a dropping comparator which has a negative input end connected to the first segment voltage, a positive input end connected to the common division voltage, and an output end that turns on or off the common dropping circuit;

a dropping adjustable resistance which is connected between an output end of the common dropping circuit and the positive input end of the dropping comparator; and a dropping resistance which is connected between the positive input end of the dropping comparator and the second segment voltage.

25. The STN LCD driver of claim 23, wherein the common dropping circuit includes a charge capacitor therein.

26. The STN LCD driver of claim 19, wherein the first common voltage generating unit comprises a common boosting circuit which receives and boosts the second common voltage, and wherein the common boosting circuit includes a charge capacitor therein.

27. A super twist nematic (STN) liquid crystal display (LCD) driver which drives an STN LCD panel, the STN LCD driver comprising:

a reference voltage generating unit which generates a reference voltage in response to an external voltage;

a voltage boosting unit which generates a boosting voltage by boosting the external voltage;

a voltage control unit which generates a first segment voltage and a second segment voltage which drive a segment electrode of the STN LCD panel in response to the reference voltage and the boosting voltage;

a first common voltage generating unit which drives a common electrode of the STN LCD panel in response to a ground voltage and the second segment voltage and generates a first common voltage having a voltage level that is M (where M is an integer) times the difference of the voltage level of the ground voltage from the voltage level of the second segment voltage; and a second common voltage generating unit which drives a common electrode of the STN panel in response to the ground voltage and the second segment voltage and generates a second common voltage having a voltage level that is 1/M ( where M is an integer) times the difference of the voltage level of the ground voltage from the voltage level of the second segment voltage.

28. The STN LCD driver of claim 27 wherein the voltage boosting unit, the first common voltage generating unit, and the second common voltage generating unit each include a boosting circuit, the boosting circuit including a charge capacitor therein.

29. The STN LCD driver of claim 27 wherein the voltage level of the second segment voltage is double the voltage level of the first segment voltage.

* * * * *